US006935428B2

(12) United States Patent
McGlothen et al.

(10) Patent No.: US 6,935,428 B2
(45) Date of Patent: Aug. 30, 2005

(54) APPARATUS AND METHODS FOR ANCHORING AND ORIENTING EQUIPMENT IN WELL CASING

(75) Inventors: Jody R. McGlothen, Waxahachie, TX (US); Steven R. Fipke, Ponoka (CA); Radu Nicolae Nistor, Edmonton (CA)

(73) Assignee: Halliburton Energy Services, Inc., Houston, TX (US)

( * ) Notice: Subject to any disclaimer, the term of this patent is extended or adjusted under 35 U.S.C. 154(b) by 15 days.

(21) Appl. No.: 10/216,906

(22) Filed: Aug. 12, 2002

(65) Prior Publication Data

US 2004/0026090 A1 Feb. 12, 2004

(51) Int. Cl.[7] ..... E21B 43/00
(52) U.S. Cl. ..... 166/313; 166/50; 166/117.6
(58) Field of Search ..... 166/313, 50, 52, 166/117.5, 117.6

(56) References Cited

U.S. PATENT DOCUMENTS

| | | | | |
|---|---|---|---|---|
| 4,506,731 A | | 3/1985 | Skinner | |
| 5,275,239 A | | 1/1994 | Obrejanu | |
| 5,566,763 A | | 10/1996 | Williamson et al. | |
| 5,613,559 A | | 3/1997 | Williamson et al. | |
| 5,615,740 A | * | 4/1997 | Comeau et al. | 166/117.5 |
| 5,944,103 A | | 8/1999 | White et al. | |
| 6,012,527 A | * | 1/2000 | Nitis et al. | 166/313 |
| 6,095,248 A | * | 8/2000 | Freeman | 166/313 |
| 6,386,287 B2 | * | 5/2002 | George | 166/313 |
| 6,427,777 B1 | | 8/2002 | Schick | |

OTHER PUBLICATIONS

Search Report for United Kingdom Application No.: GB 0318696.2, Nov. 2003.

Adam Pasicznyk, "Evolution Toward Simpler, Less Risky Multilateral Wells, " SPE/IADC 67825, dated 2001.

Dresser Oil Tools Technical Manual, "No–Go Isolation Sleeves for "LRS" Lateral Re–Entry Systems", dated Jun., 1998.

Sperry–Sun Drawing No.: 090470, "7.00 RMLS Latch Assembly Oriented", dated Nov. 16, 1995.

Search Report for United Kingdom Application No.: 0318696.2.

* cited by examiner

*Primary Examiner*—David Bagnell
*Assistant Examiner*—Matthew J. Smith
(74) *Attorney, Agent, or Firm*—Marlin R. Smith

(57) ABSTRACT

Apparatus and methods for anchoring and orienting equipment in a well provide a latch assembly having a substantially unobstructed bore, thereby increasing access and flow therethrough while the latch assembly is operatively engaged with an anchoring and orienting profile in the well. The latch assembly may include a generally tubular collet structure having multiple collets integrally formed thereon.

51 Claims, 3 Drawing Sheets

APPARATUS AND METHODS FOR ANCHORING AND ORIENTING EQUIPMENT IN WELL CASING

BACKGROUND

The present invention relates generally to equipment utilized and methods performed in conjunction with a subterranean well and, in an embodiment described herein, more particularly provides apparatus and methods for anchoring and orienting equipment in well casing.

It is well known in the art to anchor and rotationally orient equipment relative to a tubular string, such as a casing string, in a well. For this purpose, an anchoring and orienting latch profile may be formed internally in the casing string, or the latch profile may be formed in a latch coupling interconnected in the casing string. A latch assembly is attached to the equipment, and then the latch assembly is operatively engaged with the internal profile, thereby anchoring and rotationally orienting the equipment relative to the casing string.

Unfortunately, such latch assemblies typically do not have full bores therethrough, and so access and flow through these latch assemblies is restricted or unavailable. It would be very useful to have substantially unrestricted access through a latch assembly, for example, to displace a portion of the equipment, or another item of equipment (such as workover tools, wireline tools, etc.), therethrough. It would also be very useful to have substantially unrestricted flow through a latch assembly, for example, to maintain well control or to increase production flow capacity, etc.

From the foregoing, it can be seen that it would be quite desirable to provide improved apparatus and methods for anchoring and orienting equipment in a well.

SUMMARY

In carrying out the principles of the present invention, in accordance with an embodiment thereof, an equipment anchoring and orienting system is provided. Methods of anchoring and orienting equipment in a well are also provided.

In one aspect of the invention, the anchoring and orienting system may include a latch assembly having a substantially unobstructed bore therethrough. The unobstructed bore provides enhanced access and flow through the latch assembly.

In another aspect of the invention, the latch assembly may include a collet structure having multiple collets integrally formed thereon. Each of the collets has an external profile formed thereon for operative engagement with the internal profile in the well. The collet structure may be generally tubular shaped, and the latch assembly bore may extend through the collet structure.

In yet another aspect of the invention, the latch assembly may include a locking device which displaces relative to the collet structure to maintain the collets in engagement with the internal profile. The locking device may be generally tubular shaped, and the latch assembly bore may extend through the locking device.

In a further aspect of the invention, methods of anchoring and orienting items of equipment in a well are provided. A deflection device may be anchored and rotationally oriented relative to a window formed between intersecting wellbores. An opening formed through a sidewall of a casing string may be rotationally oriented relative to a passage formed through the deflection device.

These and other features, advantages, benefits and objects of the present invention will become apparent to one of ordinary skill in the art upon careful consideration of the detailed description of a representative embodiment of the invention hereinbelow and the accompanying drawings.

DETAILED DESCRIPTION

Figure 1:
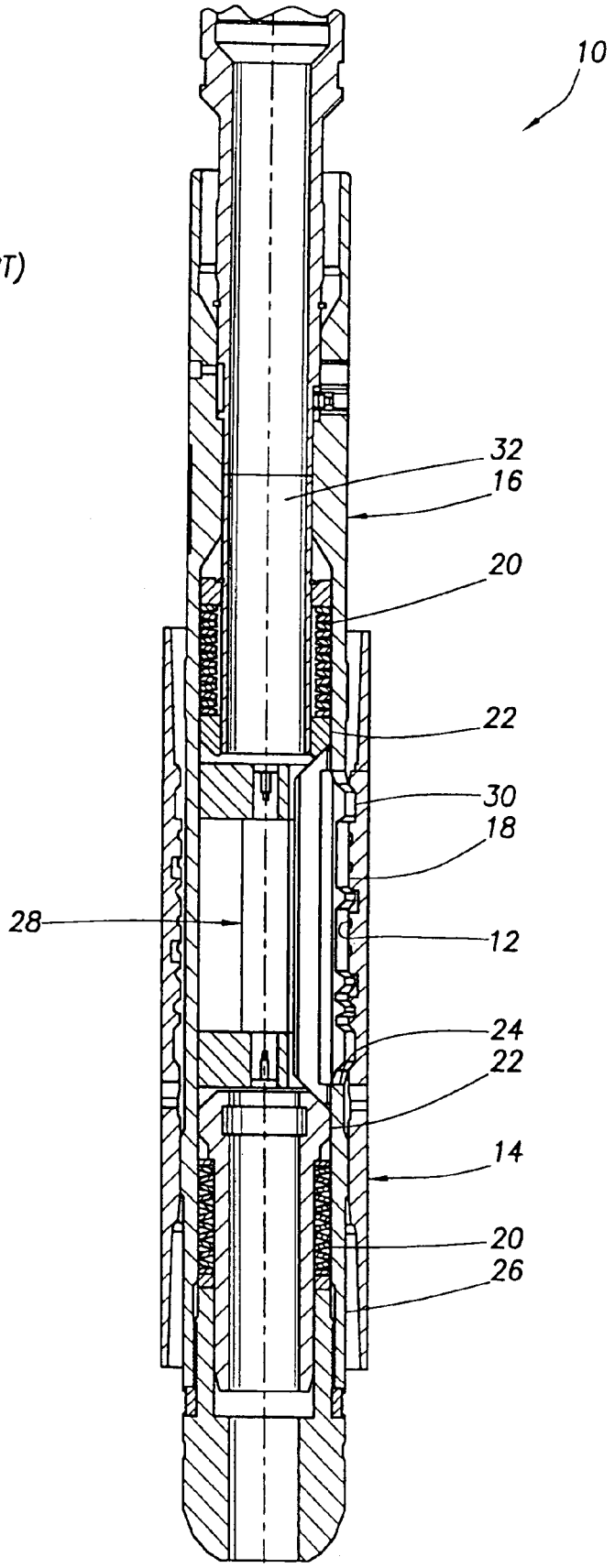
FIG. 1 (PRIOR ART)
FIG. 1 is a cross-sectional view of a prior art equipment anchoring and orienting system.

Illustrated in FIG. 1 is a prior art anchoring and orienting latch system 10 which includes an internal anchoring and orienting profile 12 formed in a latch coupling 14. The latch coupling 14 is configured to be interconnected in a casing string (not shown) and positioned in a well.

The system 10 also includes a latch assembly 16. As viewed in FIG. 1, multiple individual dogs 18 (only one of which is visible in FIG. 1) carried on the latch assembly 16 are engaged with the internal profile 12, thereby anchoring and rotationally orienting the latch assembly 16 relative to the coupling 14.

The dogs 18 are radially outwardly biased into engagement with the profile 12 by Belleville springs 20. The Belleville springs 20 urge conical wedges 22 under the dogs from above and below, thereby biasing the dogs outward.

The dogs 18 extend through elongated openings 24 formed through a sidewall of an outer housing 26 of the latch assembly 16. Alignment between the dogs 18 and the openings 24, and appropriate spacing between the dogs, are maintained by a dog alignment assembly 28. The assembly 28 also limits the outward biasing of the dogs 18, since it limits the displacement of the wedges 22 toward each other.

The anchoring and orienting functions of the latch system 10 are performed by engagement between external profiles 30 formed on each of the dogs 18 and the internal profile 12 formed in the latch coupling 14. Different profiles 30 are formed on the dogs 18 of the latch assembly 16, to correspond to different radial portions of the internal profile 12. When the latch assembly 16 is displaced into the latch coupling 14, the profiles 30 on the dogs 18 initially engage the internal profile 12 and thereby prevent further axial displacement of the latch assembly relative to the latch coupling. The latch assembly 16 is then rotated within the latch coupling 14, until each of the external profiles 30 engages the corresponding radial portion of the internal profile 12, thereby preventing further rotational displacement of the latch assembly relative to the latch coupling.

It will be readily appreciated that, although the latch system 10 may perform its anchoring and rotationally orienting functions acceptably well, it does not provide for relatively unrestricted access and flow therethrough. The multiple layers of the housing 26, springs 20, wedges 22, alignment assembly 28 and dogs 18 obstructs a bore 32 through the latch assembly 16, substantially restricting access and flow through the latch assembly. In addition, since the dogs 18 are individually assembled into the latch assembly 16, their alignment with the openings 24 is necessitated, which requires the inclusion of the alignment assembly 28 in the latch assembly. Biasing the dogs 18 outward requires the inclusion of the springs 20 and wedges 22 in the latch assembly 16. These aligning and biasing components of the latch assembly 16 not only restrict access and flow through the latch assembly 16, they also increase its manufacturing cost, maintenance cost, susceptibility to failure, difficulty of assembly, etc.

Figure 2:
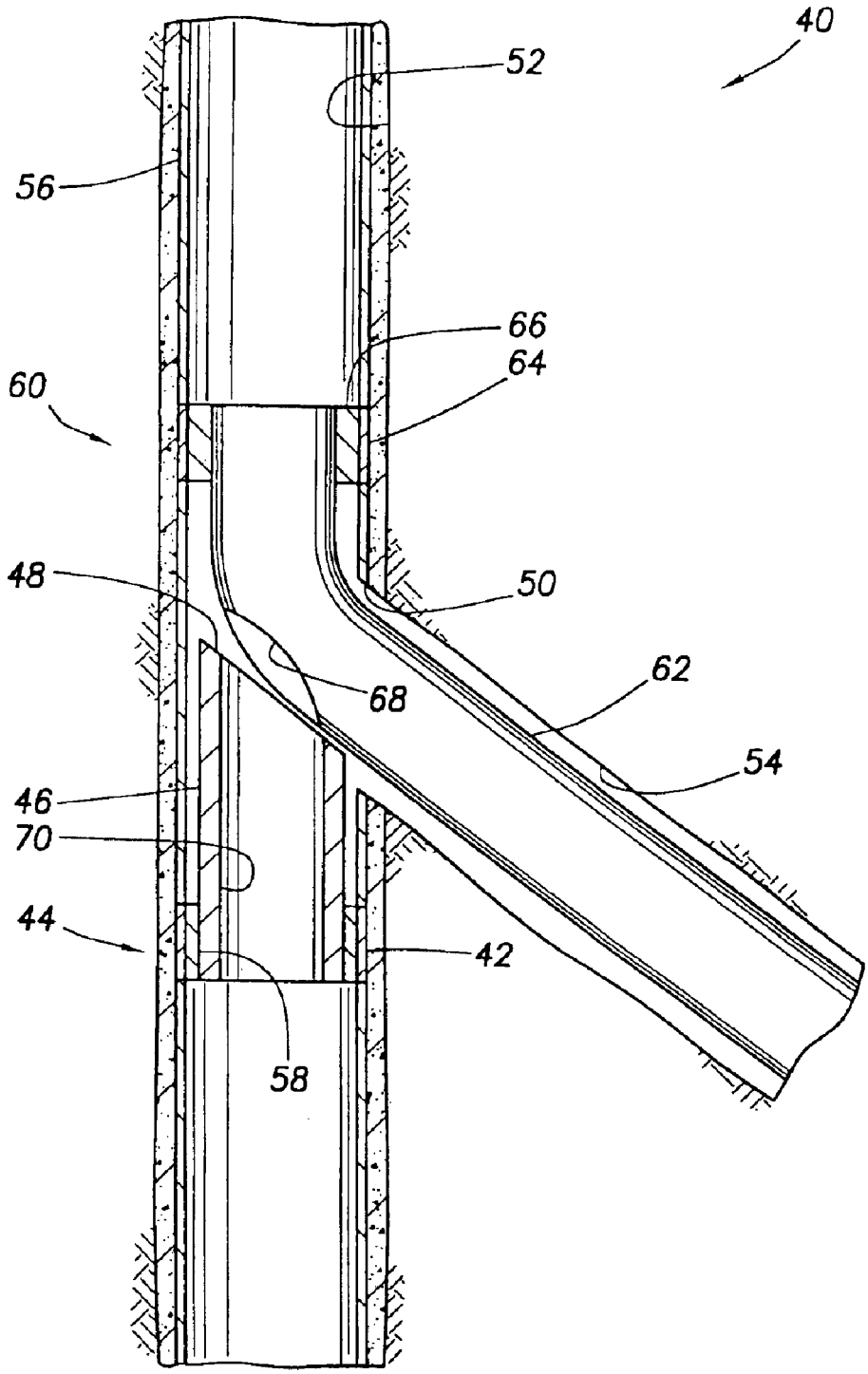
FIG. 2 is a schematic partially cross-sectional view of a method embodying principles of the present invention.

Representatively illustrated in FIG. 2 is a method 40 which embodies principles of the present invention. In the following description of the method 40 and other apparatus and methods described herein, directional terms, such as "above", "below", "upper", "lower", etc., are used only for convenience in referring to the accompanying drawings. Additionally, it is to be understood that the apparatus described herein may be utilized in various orientations, such as inclined, inverted, horizontal, vertical, etc., and in various configurations, without departing from the principles of the present invention.

In the method 40, an anchoring and orienting latch system 44 is used to anchor and rotationally orient a deflection device 46, so that an inclined upper surface 48 of the deflection device faces toward a window 50 between intersecting parent 52 and branch 54 wellbores. The window 50 is formed laterally through a sidewall of a casing string 56 cemented in the parent wellbore 52.

The latch system 44 includes a latch coupling 42, similar to the latch coupling 14 described above. The latch coupling 42 is interconnected in the casing string 56 below the window 50, and is rotationally oriented in the casing string so that an internal profile formed therein (similar to the profile 12 described above) has a known axial and rotational position relative to the window.

The latch system 44 also includes a latch assembly 58 attached to the deflection device 46. Engagement between the latch assembly 58 and the internal profile of the latch coupling 42 both axially and rotationally anchors and orients the latch assembly relative to the casing string 56 and, since the latch coupling 42 has a known axial and rotational position relative to the window 50, this engagement also anchors and orients the latch assembly (and the deflection device 46 attached thereto) relative to the window.

Another latch system 60 is used in the method 40 to anchor and orient a liner or casing string 62 in the well. The term "casing string" is used herein to designate any tubular sting which may be positioned in a wellbore as a protective lining, and the term encompasses tubulars used as casing or liner, and tubulars made of any type of material. The string 62 is lowered in the parent wellbore 52 and a lower end of the string is deflected laterally into the branch wellbore 54 by the inclined upper surface 48 of the deflection device 46.

The latch system 60 includes a latch coupling 64, similar to the latch coupling 14 described above. The latch coupling 64 is interconnected in the casing string 56 above the window 50, and is rotationally oriented in the casing string so that an internal profile formed therein (similar to the profile 12 described above) has a known axial and rotational position relative to the window.

The latch system 60 also includes a latch assembly 66 attached to the string 62. Engagement between the latch assembly 66 and the internal profile of the latch coupling 64 both axially and rotationally anchors and orients the latch assembly relative to the casing string 56 and, since the latch coupling 66 has a known axial and rotational position relative to the window 50, this engagement also anchors and orients the latch assembly (and the string 62 attached thereto) relative to the window.

The string 62 has an opening 68 formed through a sidewall thereof. The radial orientation of the string 62 relative to the window 50 also rotationally aligns this opening 68 with a passage 70 formed axially through the deflection device 46. Such alignment between the opening 68 and the passage 70 permits flow and access between the parent wellbore 52 above and below the window 50, even though the string 62 extends across wellbore to pass from the parent to the branch wellbore through the window.

Unlike the prior art latch system 10, each of the latch systems 44 and 60 provides a substantially unobstructed bore therethrough. In the method 10, this feature of the latch systems 44 and 60 permits substantially unrestricted access and flow through the string 62 and through the deflection device 46, which in turn significantly increases the variety of operations which may subsequently be performed through these items of equipment, and significantly increases the rate of fluid flow possible through these items of equipment.

It should be clearly understood, however, that the latch systems 44, 60 and the particular examples of their use in the method 40 described above are merely given to illustrate the large number of possible applications for the principles of the invention, and are not to be taken as limiting the invention to only these examples. The principles of the invention may be incorporated into a wide variety of methods wherein an item of equipment is anchored and oriented relative to an internal profile in a well.

Figure 3:
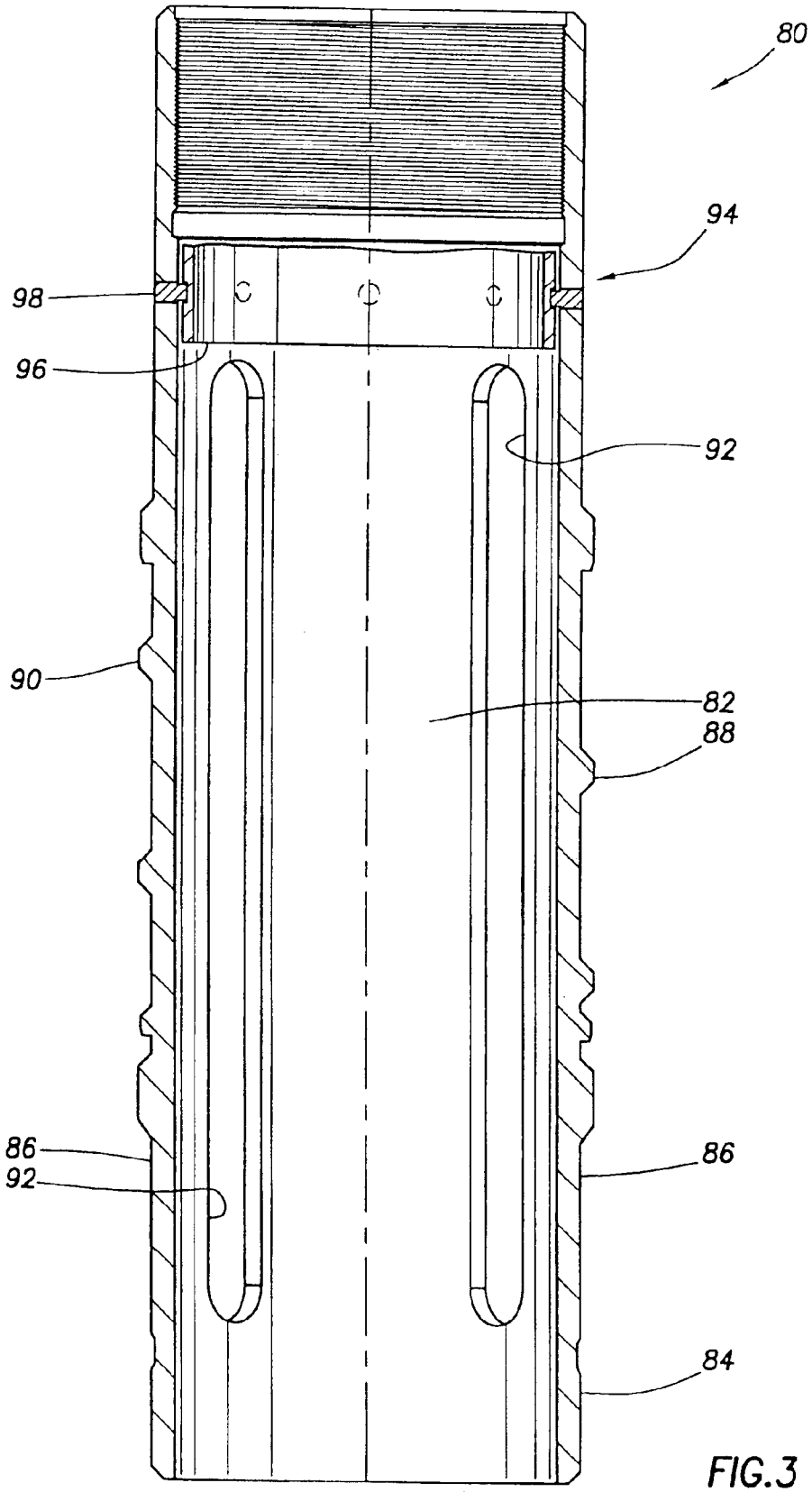
FIG. 3 is a cross-sectional view of an anchoring and orienting latch assembly embodying principles of the present invention.

Referring additionally now to FIG. 3, a latch assembly 80 embodying principles of the invention is representatively illustrated. The latch assembly 80 may be used for either or both of the latch assemblies 58, 66 in the method 40. Of course, the latch assembly 80 may be used in other methods without departing from the principles of the invention.

It will be readily appreciated that the latch assembly 80 is significantly less complex as compared to the prior art latch assembly 16 illustrated in FIG. 1. This feature of the latch assembly 80 reduces its manufacturing and maintenance costs, makes it easier to assemble correctly, reduces its susceptibility to failure, and provides other benefits. Furthermore, the reduced layers of components in the latch assembly 80 permits it to have a substantially unobstructed bore 82 therethrough, which provides enhanced access and flow through the latch assembly.

Instead of using springs and wedges to bias individual dogs through openings in an outer housing, the latch assembly 80 uses a generally tubular collet structure 84, which also serves as an outer housing of the latch assembly. The collet structure 84 has multiple circumferentially spaced apart collets 86 integrally formed thereon. As used herein, the term "integrally formed" means formed from a single piece, rather than assembled from multiple pieces attached to one another. Each of the collets 86 is separated from adjacent collets by longitudinally elongated slots 92 formed through a sidewall of the collet structure 84.

The collets 86 have external anchoring and orienting profiles 88, 90 formed thereon. Note that the profile 88 is different from the profile 90. Each of the collets 86 has an external profile formed thereon which is different from the profile on at least one of the other collets, so that the profiles correspond to an internal anchoring and orienting profile, such as the profile 12 described above.

When the collet structure 84 is inserted axially into the coupling 14, the profiles on the collets 86 initially prevent further axial displacement of the latch assembly 80 relative to the coupling 14. Rotation of the latch assembly 80 will then cause the external profiles 88, 90 to engage the corresponding radial portions of the internal profile 12, thereby rotationally anchoring and orienting the latch assembly relative to the coupling 14.

The collets 86 bias themselves outward into engagement with the profile 12, due to their own resilience. Thus, there is no need for springs, wedges, etc. to outwardly bias the collets 86.

The collet structure 84 serves as an outer housing for the latch assembly 80, thus there is no need for a separate outer housing in the latch assembly. Furthermore, since the collets 86 are integrally formed on the collet structure 84, there is no need for an alignment assembly to space out the collets relative to each other and align them with openings formed through a separate outer housing. Another benefit of integrally forming the collets 86 on the collet structure 84, even though different profiles 88, 90 are formed on the collets, is that it eliminates the possibility that the profiles will be incorrectly arranged in the latch assembly 80 so that they do not correspond to the profile 12 in the coupling 14.

To maintain the collets 86 in engagement with the profile 12, the latch assembly 80 may include a locking device 94. As depicted in FIG. 3, the locking device 94 includes a generally tubular sleeve 96 releasably secured in the collet structure 84 by shear screws 98. The sleeve 96 may be displaced downward by applying sufficient force to shear the screws 98.

With the sleeve 96 positioned radially within the collets 86, the sleeve radially outwardly supports the collets in engagement with the profile 12. Since the sleeve 96 has a tubular shape, the bore 82 can extend through the sleeve without significantly obstructing the bore.

Therefore, it will be readily appreciated that the latch assembly 80 provides a remarkably improved means of anchoring and orienting an item of equipment in a well. When used in conjunction with a latch coupling in a tubular string, as in the method 40, the latch assembly 80 provides substantially unobstructed access and flow therethrough, while being less costly to manufacture, assemble and maintain, and being less susceptible to failure, incorrect assembly, etc.

Of course, a person skilled in the art would, upon a careful consideration of the above description of representative embodiments of the invention, readily appreciate that many modifications, additions, substitutions, deletions, and other changes may be made to these specific embodiments, and such changes are contemplated by the principles of the present invention. Accordingly, the foregoing detailed description is to be clearly understood as being given by way of illustration and example only, the spirit and scope of the present invention being limited solely by the appended claims and their equivalents.

What is claimed is:

1. An anchoring and orienting latch system, comprising:

an internal anchoring and orienting latch profile in a tubular string in a well; and a latch assembly including multiple collets integrally formed on a collet structure, operative engagement of the collets with the profile anchoring and orienting the latch assembly relative to the tubular string.

2. The system according to claim 1, wherein operative engagement of the collets with the internal profile anchors the latch assembly both axially and rotationally relative to the tubular string.

3. The system according to claim 1, wherein each of the collets is separated from adjacent collets by longitudinal slots cut through the collet structure.

4. The system according to claim 1, wherein the collet structure is generally tubular shaped.

5. The system according to claim 4, wherein the collet structure forms a portion of an outer housing of the latch assembly.

6. The system according to claim 1, wherein the latch assembly has a substantially unobstructed bore therethrough.

7. The system according to claim 1, wherein each of the collets has an external profile formed thereon for operative engagement with the internal profile, and wherein each external profile is different from that formed on at least one other of the collets.

8. The system according to claim 1, wherein the latch assembly further includes a locking device which is displaced relative to the collet structure to maintain engagement of the collets with the internal profile.

9. The system according to claim 8, wherein the locking device radially outwardly supports the collets to maintain engagement of the collets with the internal profile.

10. The system according to claim 8, wherein the collet structure is generally tubular shaped, and wherein the locking device includes a generally tubular sleeve which is displaced within the tubular collet structure to maintain engagement of the collets with the internal profile.

11. The system according to claim 8, wherein the locking device provides a substantially unobstructed bore through the latch assembly.

12. An anchoring and orienting latch system, comprising:

an internal anchoring and orienting latch profile in a tubular string in a well; and a latch assembly, operative engagement of the latch assembly with the profile anchoring and orienting the latch assembly relative to the tubular string, the latch assembly having a substantially unobstructed bore therethrough, the latch assembly including a collet structure, the bore extending through the collet structure, and the collet structure including multiple collets integrally formed thereon.

13. The system according to claim 12, wherein each of the collets is separated from adjacent collets by longitudinal slots cut through the collet structure.

14. The system according to claim 12, wherein the collet structure is generally tubular shaped.

15. The system according to claim 12, wherein the collet structure forms a portion of an outer housing of the latch assembly.

16. The system according to claim 12, wherein each of the collets has an external profile formed thereon for operative engagement with the internal profile, and wherein each external profile is different from that formed on at least one other of the collets.

17. The system according to claim 12, wherein the latch assembly further includes a locking device which is displaced relative to the collet structure to maintain engagement of the collets with the internal profile.

18. The system according to claim 17, wherein the locking device radially outwardly supports the collets to maintain engagement of the collets with the internal profile.

19. The system according to claim 17, wherein the collet structure is generally tubular shaped, and wherein the locking device includes a generally tubular sleeve which is displaced within the tubular collet structure to maintain engagement of the collets with the internal profile.

20. The system according to claim 17, wherein the bore extends through the locking device.

21. A method of anchoring and orienting an item of equipment in a well, the method comprising the steps of:

attaching the item of equipment to an anchoring and orienting latch assembly including a collet structure having multiple collets integrally formed thereon; and engaging the latch assembly with an internal profile in a tubular string in the well, the collet structure preventing axial and rotational displacement of the latch assembly relative to the tubular string in response to the engaging step.

22. The method according to claim 21, wherein the engaging step further comprises engaging an external profile formed on each of the collets with the internal profile.

23. The method according to claim 22, wherein in the engaging step, each external profile is different from that formed on at least one other of the collets.

24. The method according to claim 21, wherein in the preventing step, each of the collets resists axial and rotational displacement of the latch assembly relative to the internal profile.

25. The method according to claim 21, wherein in the engaging step, the latch assembly has a substantially unobstructed bore therethrough.

26. The method according to claim 21, further comprising the step of displacing a locking device relative to the collet structure, thereby maintaining engagement of the collets with the internal profile.

27. The method according to claim 26, wherein in the displacing step, a substantially unobstructed bore of the latch assembly extends through the locking device.

28. The method according to claim 21, wherein in the attaching step, the item of equipment is a wellbore casing string, and wherein the engaging step further comprises anchoring and orienting the casing string relative to the internal profile.

29. The method according to claim 28, wherein the anchoring and orienting step further comprises anchoring and rotationally orienting the casing string relative to a window formed between intersecting parent and branch wellbores.

30. The method according to claim 29, wherein the anchoring and orienting step further comprises anchoring and rotationally orienting an opening formed through a sidewall of the casing string relative to the window.

31. The method according to claim 29, wherein in the anchoring and orienting step, the casing string extends through the window.

32. The method according to claim 28, wherein the anchoring and orienting step further comprises anchoring and rotationally orienting the casing string relative to a deflection device positioned in a wellbore.

33. The method according to claim 32, wherein the anchoring and orienting step further comprises anchoring and rotationally orienting an opening formed through a sidewall of the casing string relative to the deflection device.

34. The method according to claim 33, wherein the anchoring and orienting step further comprises aligning the opening with a passage formed through the deflection device.

35. The method according to claim 32, wherein in the anchoring and orienting step, the casing string extends through a window formed at a wellbore intersection.

36. The method according to claim 21, wherein in the attaching step, the item of equipment is a deflection device, and wherein in the engaging step, the deflection device is anchored and rotationally oriented relative to a window formed through a sidewall of the tubular string.

37. A method of anchoring and orienting an item of equipment in a well, the method comprising the steps of:

attaching the item of equipment to an anchoring and orienting latch assembly having a substantially unobstructed bore therethrough; and engaging the latch assembly with an internal profile in a tubular string in the well, thereby anchoring and rotationally orienting the item of equipment relative to the tubular string, wherein in the attaching step, the item of equipment is a wellbore casing string, and wherein the engaging step further comprises anchoring and orienting the casing string relative to the internal profile.

38. The method according to claim 37, wherein the anchoring and orienting step further comprises anchoring and rotationally orienting the casing string relative to a window formed between intersecting parent and branch wellbores.

39. The method according to claim 38, wherein the anchoring and orienting step further comprises anchoring and rotationally orienting an opening formed through a sidewall of the casing string relative to the window.

40. The method according to claim 38, wherein in the anchoring and orienting step, the casing string extends through the window.

41. The method according to claim 37, wherein the anchoring and orienting step further comprises anchoring and rotationally orienting the casing string relative to a deflection device positioned in a wellbore.

42. The method according to claim 41, wherein the anchoring and orienting step further comprises anchoring and rotationally orienting an opening formed through a sidewall of the casing string relative to the deflection device.

43. The method according to claim 42, wherein the anchoring and orienting step further comprises aligning the opening with a passage formed through the deflection device.

44. The method according to claim 41, wherein in the anchoring and orienting step, the casing string extends through a window formed at a wellbore intersection.

45. A method of anchoring and orienting an item of equipment in a well, the method comprising the steps of:

attaching the item of equipment to an anchoring and orienting latch assembly having a substantially unobstructed bore therethrough; and engaging the latch assembly with an internal profile in a tubular string in the well, thereby anchoring and rotationally orienting the item of equipment relative to the tubular string, wherein in the engaging step, the latch assembly includes a collet structure having multiple collets integrally formed thereon, the collet structure preventing axial and rotational displacement of the latch assembly relative to the tubular string in response to the engaging step.

46. The method according to claim 45, wherein the engaging step further comprises engaging an external profile formed on each of the collets with the internal profile.

47. The method according to claim 46, wherein in the engaging step, each external profile is different from that formed on at least one other of the collets.

48. The method according to claim 45, wherein in the preventing step, each of the collets resists axial and rotational displacement of the latch assembly relative to the internal profile.

49. The method according to claim 45, further comprising the step of displacing a locking device relative to the collet structure, thereby maintaining engagement of the collets with the internal profile.

50. The method according to claim 49, wherein in the displacing step, the bore of the latch assembly extends through the locking device.

51. The method according to claim 45, wherein in the engaging step, the bore of the latch assembly extends through the collet structure.

* * * * *